US005276944A

United States Patent [19]

Lin

[11] Patent Number: 5,276,944

[45] Date of Patent: * Jan. 11, 1994

[54] QUICK RELEASE HINGE

[76] Inventor: Tsong C. Lin, No. 146, Ta Hu Vill. Hu-Nei, Hsiang, Kaohsiung Hsien, Taiwan

[ * ] Notice: The portion of the term of this patent subsequent to Apr. 21, 2009 has been disclaimed.

[21] Appl. No.: 875,414

[22] Filed: Apr. 29, 1992

[51] Int. Cl.[5] ..... E05D 7/10

[52] U.S. Cl. ..... 16/258; 16/251; 16/DIG. 43

[58] Field of Search ..... 16/250, 251, 258, DIG. 43

[56] References Cited

U.S. PATENT DOCUMENTS

| | | | |
|---|---|---|---|
| 4,800,621 | 1/1989 | Rock et al. | 16/254 |
| 4,847,948 | 7/1989 | Gross et al. | 16/DIG. 43 |
| 4,881,297 | 11/1989 | Grass | 16/258 |
| 5,105,506 | 4/1992 | Lin | 16/258 |

*Primary Examiner*—Lowell A. Larson
*Assistant Examiner*—Donald M. Gurley
*Attorney, Agent, or Firm*—Jacobson, Price, Holman & Stern

[57] ABSTRACT

A quick release hinge has a base plate, a pivot arm, a connecting plate assembly and a toggle segment, through holes, bolt, pins disposed thereon, can be released quickly.

1 Claim, 5 Drawing Sheets

QUICK RELEASE HINGE

BACKGROUND OF THE INVENTION

A hinge structure is disclosed in a U.S. patent application Ser. No. 07/641,715 entitled "Quick Release Hinge With Resilient Latch", now U.S. Pat. No. 5,105,506, which comprises a base plate, a connecting plate assembly and a pivot arm. The connecting plate assembly has a connecting plate, a retaining plate, and a toggle segment. The connecting plate has hooks to engage shafts on the base plate, the retaining plate is provided with a protruded lip at the bottom, and the protruded lip is to engage the base of a protrusion in the base plate 1. Then the base plate is assembled with the connecting plate assembly. The toggle segment is pivotally movable and has two legs pressing two wings in the retaining plate to force the protruded lip in the retaining plate to separate from the base of the protrusion in the base plate so that the connecting plate separates from the base plate. However, the toggle segment is rather small in its dimensions, so its movement is rather hard when this hinge is moved to open or close. In addition, this hinge is usually covered with an ornamental cover, which has to be taken off and put on in case of adjusting this hinge. And the ornamental cover is often neglected to be put on by a lazy worker.

SUMMARY OF THE INVENTION

The object of this invention is to provide a quick release hinge having a rather longer toggle segment than that used in the previous U.S. patent application Ser. No. 07/641,715, to facilitate its movement in relation to the connecting plate body, and has a post to engage in a rectangular hole in the pivot arm for keeping it securely on the pivot arm and a long flat surface for an ornamental design.

BRIEF DESCRIPTION OF DRAWINGS

This invention will now be described in detail with reference to accompanying drawings wherein.

DETAILED DESCRIPTION OF THE INVENTION

Figure 1:
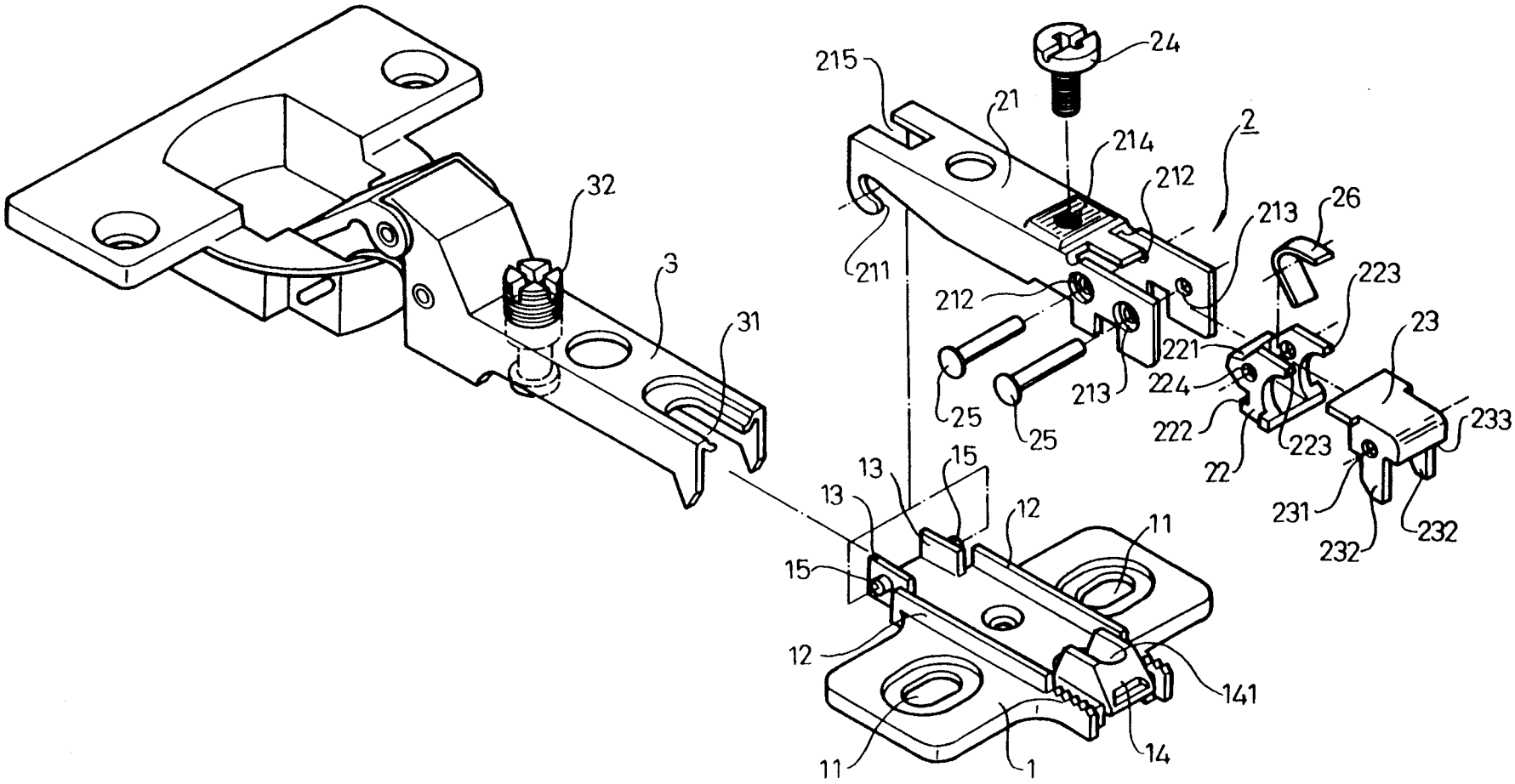
FIG. 1 is an exploded perspective view of the U.S. patent application Ser. No. 07/641,715.
Figure 2:
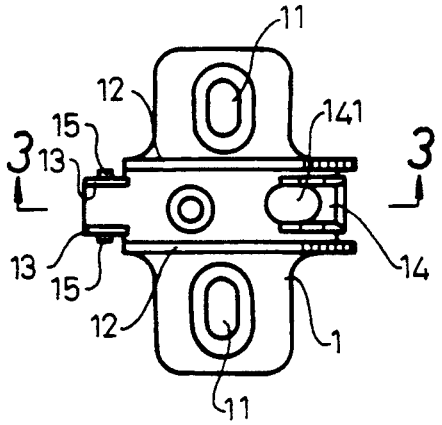
FIG. 2 is a plan view of a base plate in the U.S. patent application Ser. No. 07/641,715.
Figure 4:
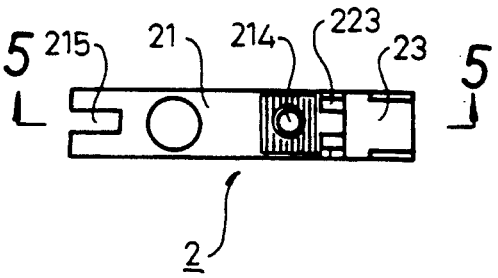
FIG. 4 is a plan view of a connecting plate in the U.S. patent application Ser. No. 07/641,175.
Figure 3:
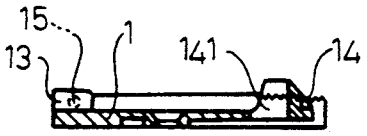
FIG. 3 is a cross-sectional view taken along line 3—3 of FIG. 2.
Figure 5:
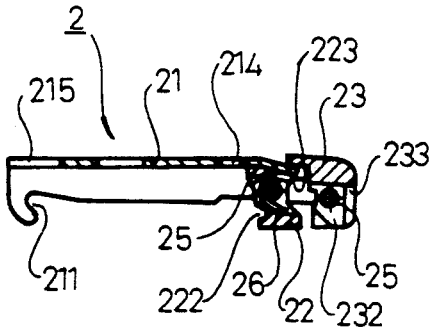
FIG. 5 is a cross-sectional view taken along line 5—5 of FIG. 4.
Figure 6:
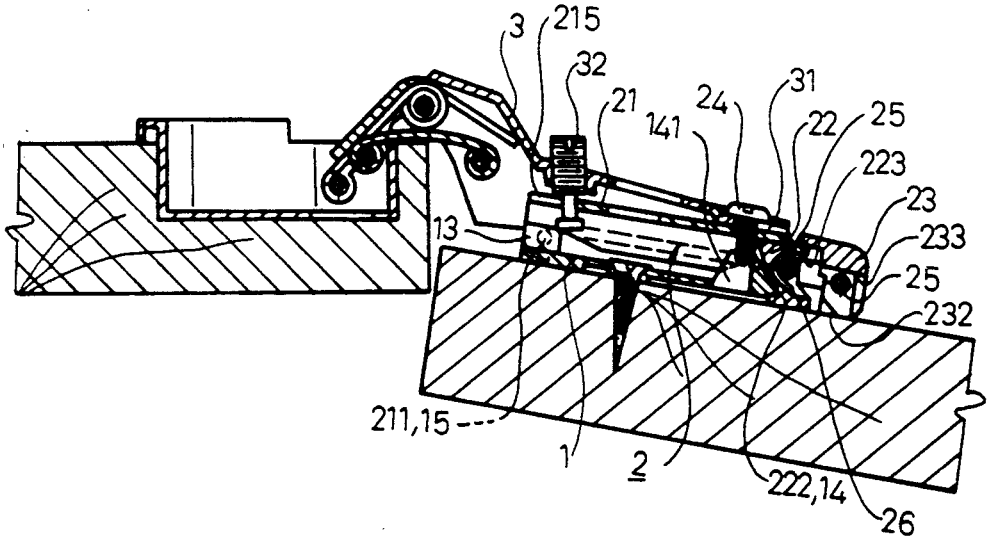
FIG. 6 is a sectional elevation of the hinge in an open position in the U.S. patent application Ser. No. 07/641,715.
Figure 7:
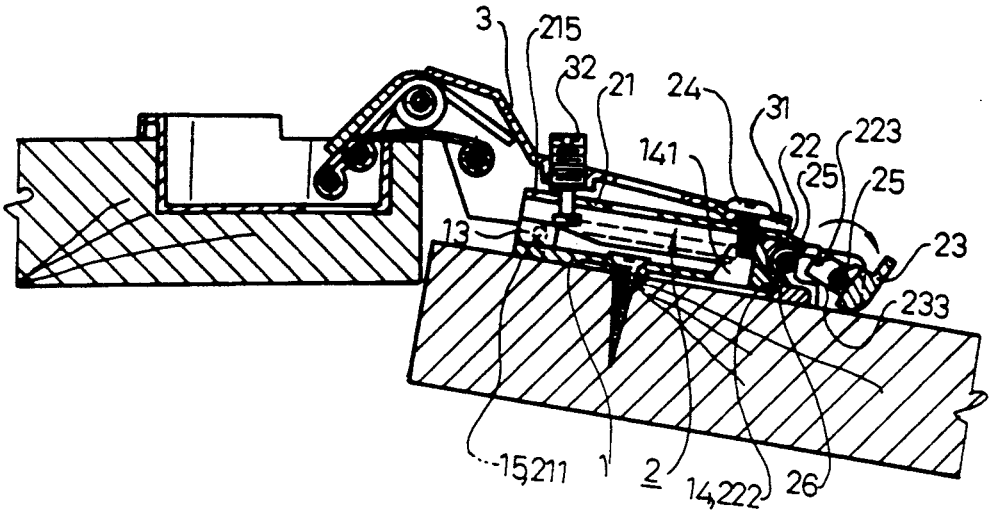
FIG. 7 is a sectional elevation of the hinge showing a separating movement in the U.S. patent application No. 07/641,715.
Figure 8:
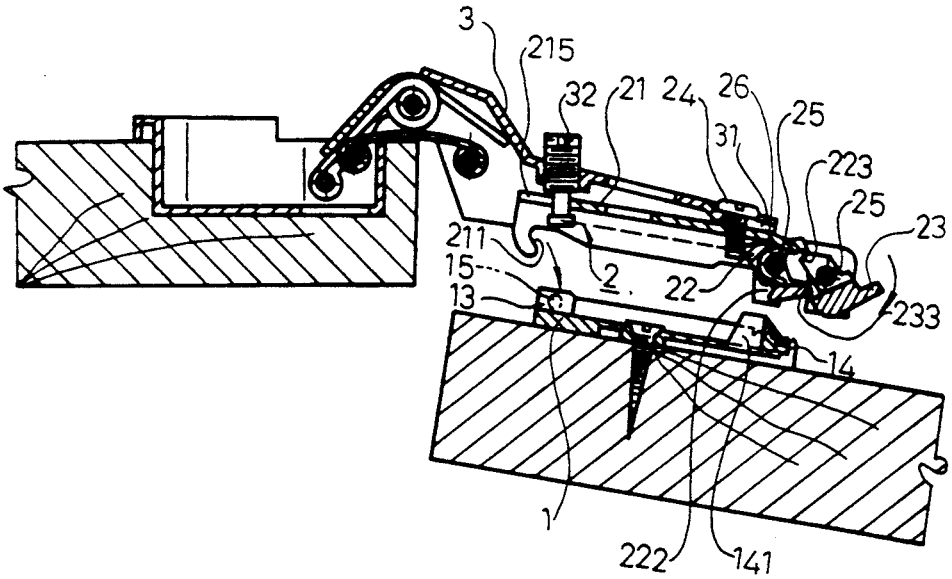
FIG. 8 is a sectional elevation of the hinge in a separated position in the U.S. patent application Ser. No. 07/641,715.
Figure 9:
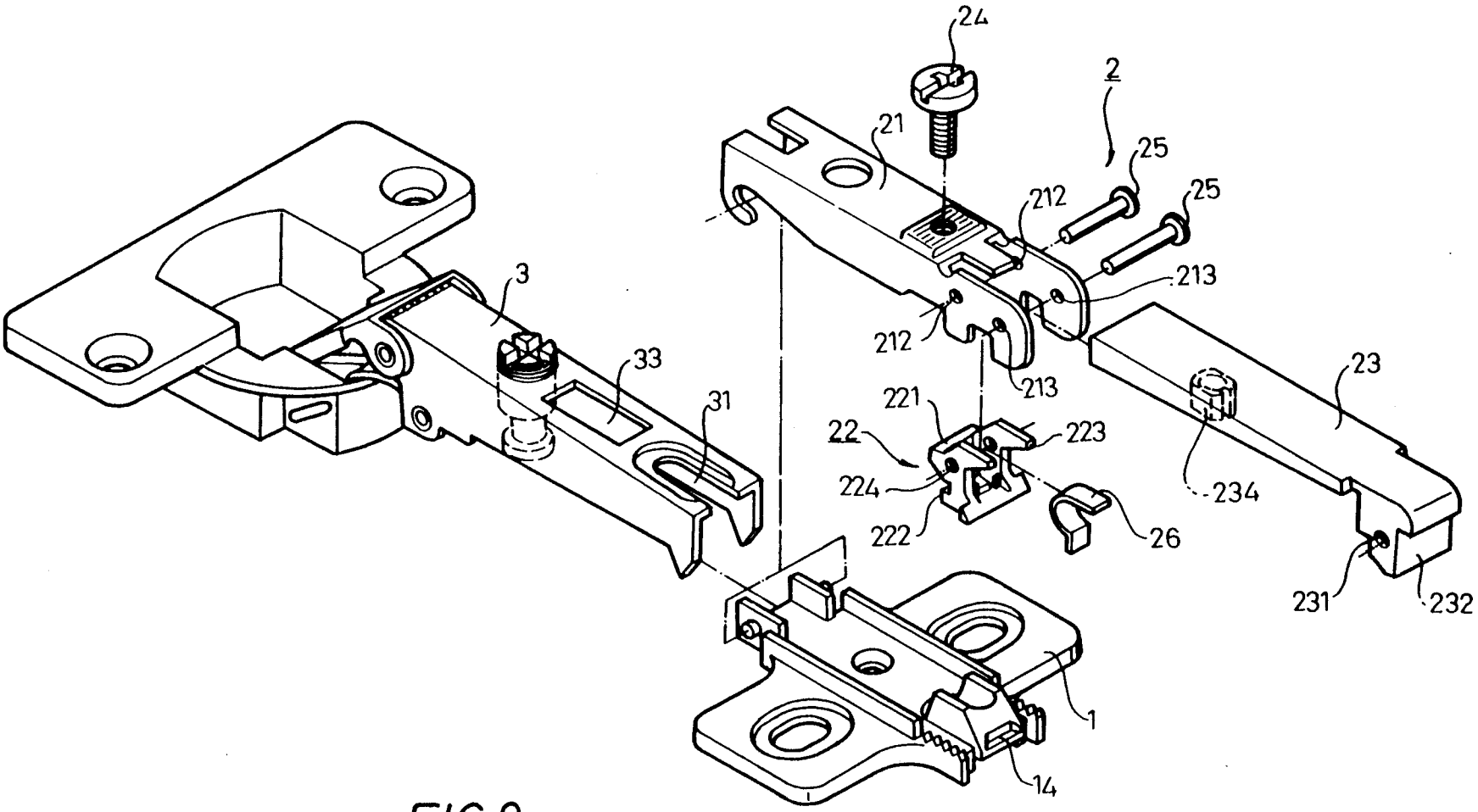
FIG. 9 is an exploded perspective view of the hinge in the present invention.

Referring firstly to FIG. 9, a hinge in accordance with the present invention comprises a base plate 1, a connecting plate assembly 2 and a pivot arm 3. The base plate 1 and the pivot arm 3 are almost of the same structure as those in the previous U.S. patent application Ser. No. 07/641,715, now U.S. Pat. No. 5,105,506.

The pivot arm 3 in this invention is only different from that in the previous U.S. patent application Ser. No. 07/641,715 in having a rectangular hole 33 instead of a round hole. The rectangular hole 33 has its lengthwise central line the same as or parallel to the moving line of a bolt 24 inserting in an open slot 31 in the pivot arm 3.

The connecting plate assembly 2 comprises a channel-shaped body 21, a retaining plate 22 and a toggle segment 23. The retaining plate 22 and the toggle segment 23 are pivotally connected with the body 21 by means of pins 25 inserted through shaft holes 212 and 213 in opposite sidewalls of the body 21. And a spring 26 is inserted between the retaining plate 22 and the body 21 to elastically push the retaining plate 22.

The main different feature of the present invention is the toggle segment 23, which has a comparative long length, a hole 231 for one of the pins 25 to pass through to combine the toggle segment 23 with the body 21, and a downward projection 232 for pushing the lower edges of the wings 223 in the retaining plate 22, enabling the the retaining plate 22 to rotate to make a protruded lip 222 disengage the base of the projection 14 in the base plate 1. The toggle segment 23 pivots for nearly 100 degrees with the pin 25 as a pivot, 90 degrees for idle pivoting and 10 degrees for moving the retaining plate 22. The length of the toggle segment 23 is made enough to shield a large part of the pivot arm 3, and a downward post 234 is provided in the bottom of the toggle segment 23 for tightly engaging the rectangular hole 33 in the pivot arm 3 owing to its certain elasticity.

Figure 10:
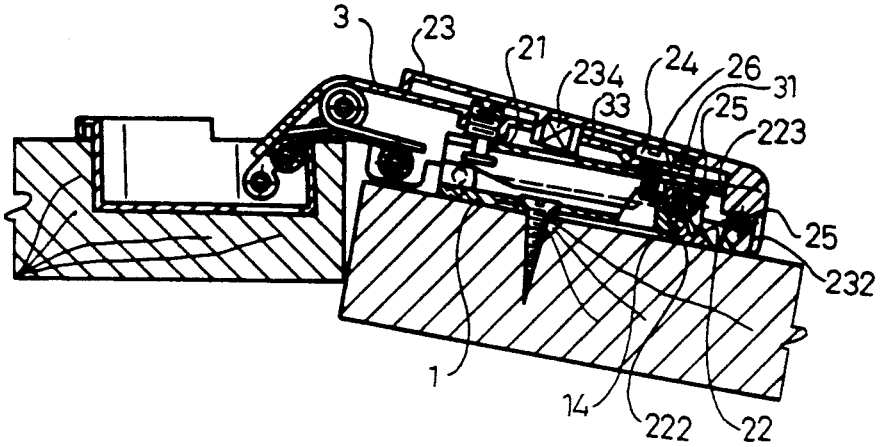
FIG. 10 is a cross-sectional view of the hinge fixed on a piece of furniture in the present invention.

FIG. 10 shows that this hinge is fixed on the side wall and the door of a furniture article. Then the post 234 in the toggle segment 23 is engaging the rectangular hole 33, and the upper surface of the toggle segment 23 is smooth and long, possible to be printed thereon with a mark or a design so as to beautify outlook of the product. In case the pivot arm 3 is necessary to be moved, the toggle segment 23 can be pivoted up, enabling the bolt 24 to be screwed and be moved in the open slot 31 as shown in FIG. 9. After the bolt 24 is moved and screwed tight in a new position, the toggle segment 23 is pivoted back to shield the pivot arm 3, with the post 234 engaging in the rectangular hole 33.

Figure 11:
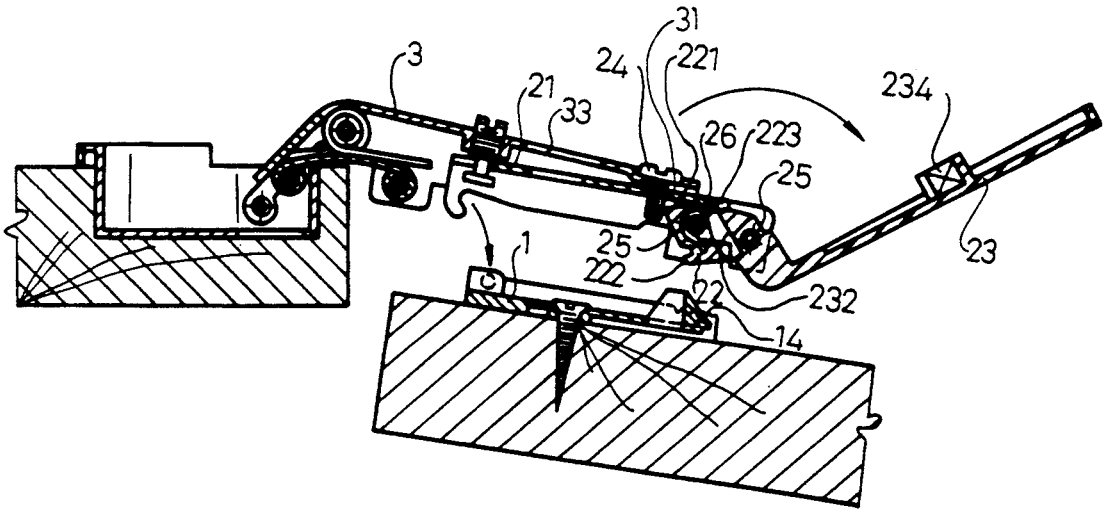
FIG. 11 is a cross-sectional view of the hinge fixed on a door of a furniture article and the base plate separated from the rest components in the present invention.

As FIG. 11 shows, suppose the whole connecting plate assembly 2 has to be disassembled from the base plate 1, the toggle segment 23 is pivoted for about 100 degrees, forcing the projection 232 to press the wings 223 in the retaining plate 22 as to let the protruded lip 222 separated from the base of the projection 14 in the base plate 1. Then the base plate 1 is completely disassembled from the rest parts of the hinge.

What is claimed is:

1. A quick release hinge for attaching a door of a furniture article to a side wall of the article comprising;

a base plate for connection to one of said door and wall;

an elongate pivot arm for connection to the other of said door and wall, the pivot arm being provided with a rectangular hole and an adjacent open slot extending lengthwise of the pivot arm; and a connecting plate assembly for releasable attachment between the base plate and the pivot arm;

said base plate having an elongate track, a pair of walls at one end of said track with respective projecting stub shafts and a projection for assembling with a protruded lip of a retaining plate;

said connecting plate assembly comprising an elongate channel-shaped body, connection means attaching the body to the pivot arm including a bolt extending into said open slot, hooks at one end of the body for engaging over said stub shafts on the base plate, and a retaining plate pivotally connected to the body adjacent an opposite end of the body;

said retaining plate having a lip for engaging under a bottom surface of the projection on the base plate to latch the connecting plate assembly to the base plate when said hooks are engaged over said stub shafts, biasing means between the body and said retaining plate urging the lip to engage under said bottom surface, and outwardly extending wings on the retaining plate;

a toggle segment pivotally connected to the body at said opposite end of the body in lengthwise adjacent relation to the retaining plate;

said toggle segment having a downward projection for engaging the wings on the retaining plate when the toggle segment is pivoted in one direction and thereby pivoting the retaining plate in the opposite direction against the action of the biasing means so as to disengage said lip from under the bottom surface of the projection on the base plate and allow the connecting plate assembly to be unlatched from the base plate, a long flat body to lie on a large portion of the pivot arm and a downward post to engage said rectangular hole in the pivot arm;

said bolt being movable in said open slot along a moving line to adjust the pivot arm and said rectangular hole in the pivot arm having a central line corresponding with or parallel to the moving line of said bolt in said open slot.

* * * * *